United States Patent [19]

Marcmann

[11] 4,102,103

[45] Jul. 25, 1978

[54] BREECHING INSULATION PANELS AND METHOD OF CONSTRUCTION

[76] Inventor: Emil Marcmann, P.O. Box 5, Medford, N.J. 08055

[21] Appl. No.: 768,541

[22] Filed: Feb. 14, 1977

[51] Int. Cl.[2] ..... E04B 2/00

[52] U.S. Cl. ..... 52/406; 52/474; 52/506

[58] Field of Search ..... 52/404, 406, 407, 235, 52/506, 508, 510; 220/15, 9 LG; 110/1 A; 432/247

[56] References Cited

U.S. PATENT DOCUMENTS

| | | | |
|---|---|---|---|
| 1,763,606 | 6/1930 | Sullivan | 52/506 |
| 1,868,253 | 7/1932 | Rackebrandt | 52/506 |
| 2,971,616 | 2/1961 | Bayley | 52/406 |
| 3,054,482 | 9/1962 | Lassen | 52/582 |
| 3,412,518 | 11/1968 | Waite | 52/249 |
| 3,427,775 | 2/1969 | Bachrich | 52/404 |
| 3,462,905 | 8/1969 | Regnier | 52/404 |
| 3,872,636 | 3/1975 | Nicosia | 52/404 |
| 3,975,879 | 8/1976 | Birch | 52/404 |

*Primary Examiner*—John E. Murtagh
*Attorney, Agent, or Firm*—Frank P. Cyr

[57] ABSTRACT

A structural insulating panel particularly adapted for use in static structures for containing or conveying a body of fluid at a temperature elevated with respect to the surrounding environment is disclosed. The panel comprises a supporting member from which is hung an inside material retaining sheet having an angled portion along a lower edge forming a shelf upon which is supported a block of insulating material. A metal facing sheet is positioned on the outside of the insulating material and spaced from the inside material retaining sheet by a plurality of tubular spacer means while protecting the interstitial block of insulating material. The panel is secured together as a working unit by a plurality of screw-threaded fasteners threaded onto studs extending from the horizontal supporting member. A plurality of uniformly dimensioned panels is used in combination with an underlying framework to construct a desired structure with a minimum amount of skilled labor.

12 Claims, 7 Drawing Figures

FIG. 1
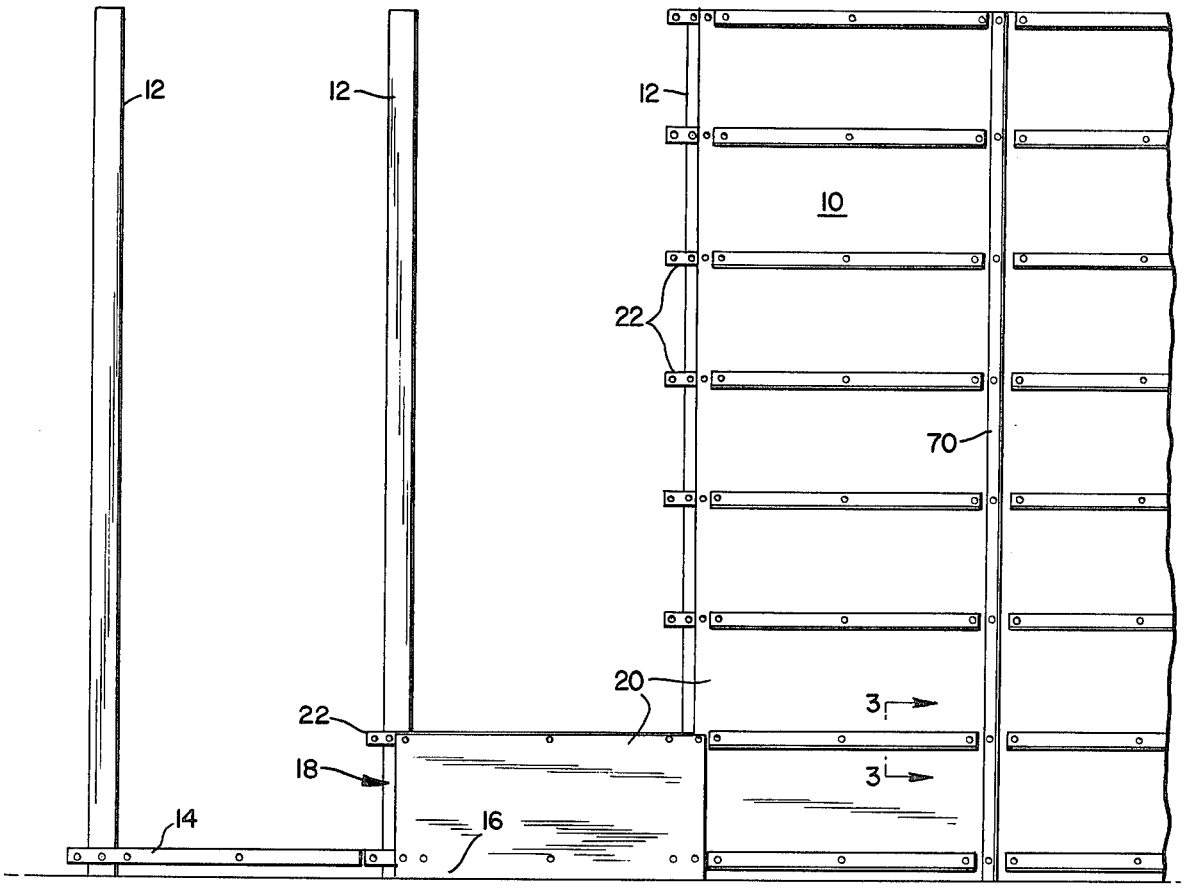
FIG. 4
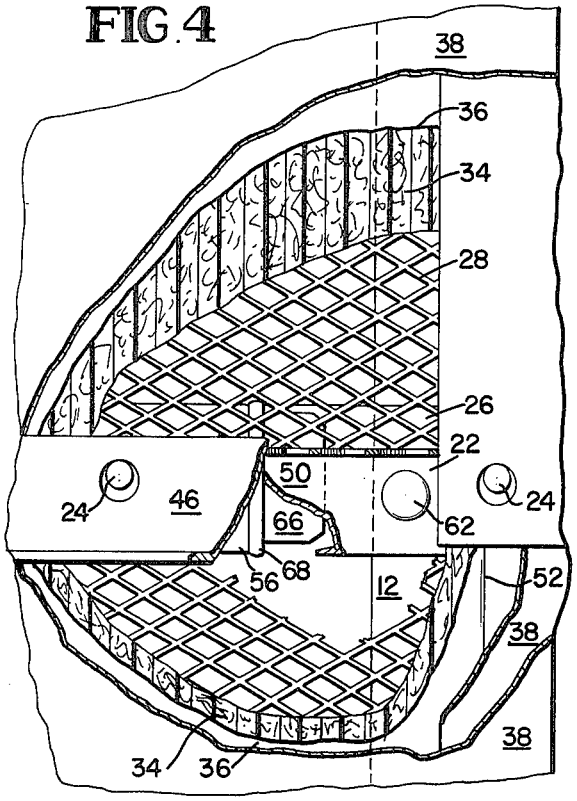
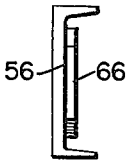
FIG. 5
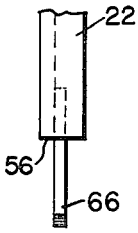
FIG. 6
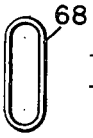
FIG. 7

BREECHING INSULATION PANELS AND METHOD OF CONSTRUCTION

BACKGROUND OF THE INVENTION

1. Field of the Invention

This invention relates most generally to static structures comprising a plurality of coplanarly arranged segments applied to an underlying framework as a veneer for both closing and insulating the static structure from the surrounding environment. The invention further relates to the particular pre-assembled sheet lamina component for segments which are adapted for uniform pre-assembly manufacture for later utilization in construction. The invention also relates to the method of construction including means to insure proper temperature expansion compensation of the structure.

2. Description of the Prior Art

Prior attempts to construct insulated static structures capable of maintaining a body of gas at a temperature significantly elevated with respect to the surrounding environment typically consisted of forming an underlying framework and then placing on that framework a number of layers of materials designed to insulate the static structure. The usual sequence of layers was constructed by first fastening inner metal sheets to the framework and then, in separate operations, adding a layer of insulating material and an outer metal sheet perhaps with the inclusion of one or more vapor barriers and finally securing all of the layers together. Such a building procedure typically required the use of workers having more than ordinary skill to align properly and assemble the multiple layers to guarantee their uniformity and structural integrity.

Some prior attempts have been made at constructing insulated static structures of this type utilizing unit panels which were secured to an underlying framework by specially formed side or corner engaging means. The panel's dimensions were dictated by the underlying framework and often problems were encountered when measurement errors were discovered in the construction of the underlying framework which prevented the panels from fitting, thus necessitating a modification in either the underlying framework or the panel itself. These modifications in the field required the constant attendance of an engineer capable of recognizing the overall effect of such a redesign in the field and its relationship to the overall project, thus significantly increasing the labor costs incurred during construction.

It was therefore determined that a further improvement in unit construction practices and in the products used in those practices was needed such that nominal errors in the erection of the underlying framework would be of little or no significance when the uniformly constructed panels were attached to the framework. Attention was given to rethinking the construction of the unit panels so that the skill of the laborer needed in the field for construction could be minimized. Finally, thought was given to providing means within each of the panels for compensating for any thermal expansion experienced due to variations in the temperature of the gas contained within the structure.

SUMMARY OF THE INVENTION

After careful consideration of each of the various limitations previously discussed it was discovered that a significant improvement in building practices could be achieved by requiring that each of the utilized building panels carry, as in integral portion, part of the structural or supporting framework which actually forms the static structure to be constructed. It was further discovered that a temperature compensating feature could be included in that portion of the framework carried by the unitized building panel. Additionally, it was recognized that by constructing the unitized building panel at a manufacturing facility especially designed for such construction, significant increases in quality control could be exercised over that to be experienced by construction in the field.

The basic unitized panel according to this invention comprises a supporting member which supports the remaining components of the structural panel when attached to the underlying framework of the static structure. An inner sheet is hung from the supporting member while a layer of insulating material covers this inner sheet. An outer sheet covers the insulating material, however, there is included means between the inner and outer sheet for preventing the collaspe of the interstitial layer of insulating material. The outer sheet and inner sheet are connected to, and are supported by, the supporting member. The supporting member extends beyond at least one of the lateral dimensions of the remaining components of the structural panel so as to permit its attachment to an underlying framework of upright I-shaped members. Means is included on one end of the supporting member for permiting the thermal expansion of the unitized panel once the resultant static structure is submitted to conditions of elevated temperature.

This general design takes form by either utilizing an existing framework or constructing an underlying framework for supporting a veneer of insulating panels. Usually the framework comprises a plurality of uniformly spaced-apart, vertically oriented, I-shaped members. Any specially constructed portion of the framework can be maintained in its uniformly-spaced condition, at least temporarily, by appropriate ties, diagonal braces, and the like. A plurality of insulating panels are then attached to the framework by means of a ramset stud, or the like, which passes through the supporting member which forms a portion of the panel and the underlying vertically oriented I-shaped member. This ease in attachment is assured by having a portion of the supporting member which forms a portion of the unitized panel extend a substantial distance beyond the lateral dimension of the remaining components forming the panel.

In a preferred embodiment the panel comprises an elongated supporting member having a unit length substantially equal to the center-to-center spacing between the I-shaped members of the underlying framework. The horizontally elongated supporting member is preferably a channel member having a plurality of studs extending orthogonally from the web of the channel member and away from the I-shaped members of the framework. An inside material-retaining sheet, made preferably of expanded metal lath, is hung on the plurality of studs. The material-retaining sheet has an angled portion which extends along the length of the lower edge of the material-retaining sheet forming a shelf.

A generally rectangular layer or block of insulating material is positioned against the material retaining sheet between the shelf and the studs. The insulating material preferably comprises a batt of fiberglass retained at a density of about 3.25 pounds per cubic foot in a stiff board-like configuration by sodium silicate or other similar binders. The block or layer of fiberglass is preferably enclosed and sealed in an envelope of a plastic meterial such as polyethylene or the like. A facing sheet, preferably of metal which may be decoratively coated or embossed, is then positioned over the insulating meterial and engages the studs from the supporting member to form an outside surface of the insulating panel. The facing sheet can extend beyond the lateral dimension of the layer of insulating material on one or more, and preferably two of the four, sides of the insulating panel so as to permit overlap of the facing sheet with the next adjacent panels.

A tubular spacer means surrounds the studs which extend outward from the horizontally elongated channel members, the tubular spacer means maintaining the optimum or necessary distance between the inside material retaining sheet and the metal facing sheet so as to prevent the collapse of the interstitial layer of insulation material. A plurality of screwthreaded fasteners cooperatively engages the plurality of studs to maintain the components of the insulating panel in a fixed relationship with each other.

The insulating panel can also include an upper margin defining means which is preferably an angled member positioned between the facing sheet and the upper edge of the block of insulating material for defining an upper surface upon which the next vertically adjacent structed panel can be conveniently positioned. The upper margin defining means assists in the formation of a weather-tight seal along overlapping portions of adjacent insulating panels. The upper margin defining means also aids in protecting the layer of insulating material from unnecessary wear and tear prior to and during the construction of the static structure in which it is ultimately incorporated. The structural insulating panel can also include one or more vertically oriented reinforcing means positioned between the layer of insulating material and the facing sheet to reinforce and stabilize the facing sheet especially when it might be subject to high wind load or other compressive stress. The vertically oriented reinforcing means, which also help maintain the vertical dimensions, can simply comprise angle members extending downwardly from one or more of the studs which engage the upper margin of the facing sheet. Additional horizontal and vertical load distributing members on the exterior surface aid in maintaining weather-tight seals even under adverse weather conditions.

One important feature of the invention is that one end of the horizontally elongated supporting member extends a substantial distance beyond the lateral edge of the inside material-retaining sheet while an opposite end of the supporting member is receded a simililar substantial distance from the opposite lateral edge of the material retaining sheet. This offset or difference between the termination points of the supporting member and the remaining members of the insulating panel contributes significantly to the ease with which a static structure according to this invention may be assembled. That portion of the supporting member which extends beyond the lateral edge of the remaining components of the insulating structural panel is used as the site for the single point of attachment between the panel and the underlying vertical framework. The close tolerances under which each of the panels is manufactured permits the final assembly of the static structure based upon simply bringing the appropriate edges of adjacent panels into the desired mating relationship and then securing the horizontally elongated supporting member of the particular panel to the underlying framework.

Another important feature of the invention is the presence of a tongue-like member projecting from one end of the horizontally elongated supporting member for engaging an appropriately mating end of a like supporting member in an adjacent panel. The tongue-like member insures the proper mating engagement of the neighboring panels. Still another important feature is the presence of a spacer means which is fitted on the end of the horizontally elongated supporting members for separating the respective ends of adjacent supporting members. The spacer means is most conveniently fitted over the projecting tongue-like member on the end of each of the supporting members. The spacer means functions to assure the proper spacing remains between panels to permit thermal expansion and contraction due to changes in the ambient temperature both inside and outside of the static structure. Preferably the spacer means comprises an element constructed of one or more materials generally referred to as thermoplastic resins which would be form-stable at any temperature ordinarily encountered during the construction of such a static structure (up to at least 125° F) but which would become plastic and at least deform, if not completely melt, once the structure is put to its final function of containing or conveying gas at significantly elevated temperatures with respect to the surrounding environment. Structures according to this invention when used to handle flue gas or exhaust gas from furnaces and ovens can utilize spacer means in the form of rings or ovals made of nylon.

A clearer understanding of the specific features and advantages of a static structure constructed according to this invention can be gained from a consideration of the accompanying figures together with the following description of the preferred embodiments in which similar portions of the invention have been indicated by the same numeral in all figures.

BRIEF DESCRIPTION OF THE DRAWINGS

FIG. 1 is a side elevation view of a static structure in the midst of construction utilizing the advancements of this invention.

FIG. 4 is an elevation view partially in section, illustrating in detail the inner relation between structures at the junction of a plurality of insulating panels as they are finally placed in a static structure as illustrated in FIG. 1.

FIG. 5 is an end view of a supporting member illustrating the presence of the tongue-like projection shown also in FIG. 4.

FIG. 6 is a plan view of the structure illustrated in FIG. 5.

FIG. 7 is an illustration of a spacer means which can be used to provide temperature compensation in a structure according to this invention.

DESCRIPTION OF PREFERRED EMBODIMENTS

Figure 2:
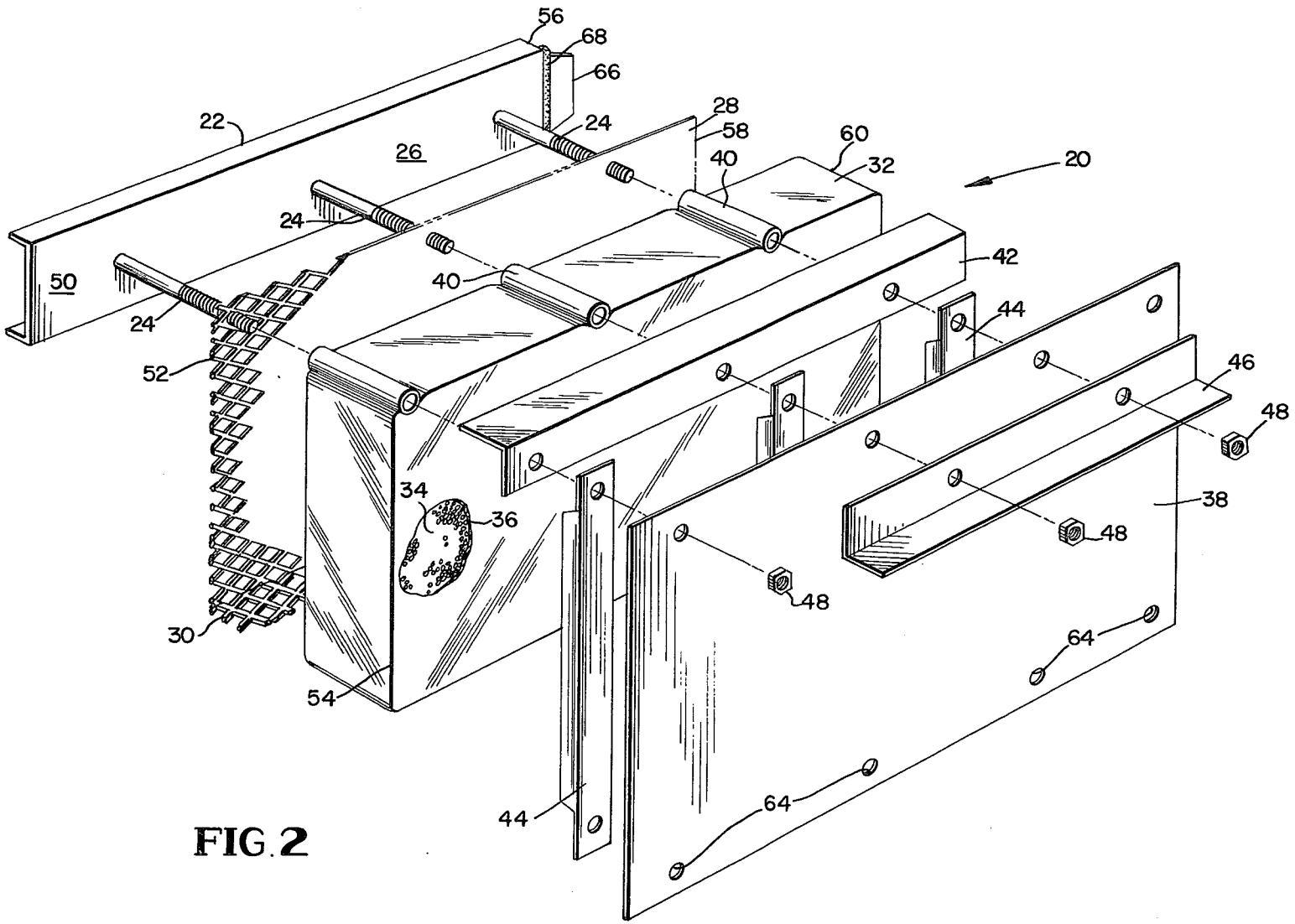
FIG. 2 is an exploded perspective view of an insulated structural panel according to this invention, a plurality of which are used to construct the static structure illustrated in FIG. 1.

A static structure 10, illustrated in partial completion in FIG. 1, and specifically designed to contain or convey gas at a temperature elevated with respect to the surrounding environment can be constructed by first positioning a plurality of I-shaped members 12 into a vertical and uniformly spaced-apart orientation. The I-shaped members 12 may be fixed to any convenient base, substructure, or foundation which is appropriate to the location. The members 12 can be maintained in that uniformly spaced position, either temporarily or permanently by whatever, ties, braces, or the like are believed to be necessary for the particular installation. A horizontally enlongated member 14 is then attached near the bottom of the I-shaped members joining them together and forming a bottom rail to which the lower edge 16 of the bottom row 18 of panels can be attached. The panels 20, each of which are illustrated in exploded perspective view in FIG. 2, are then attached to the vertically oriented I-shaped members 12 starting first with the bottom row 18 and then with successive vertically adjacent panels. The arrangement of the plurality of panels to form the static structure 10 can be best understood by first considering the structure of an individual panel as illustrated in FIG. 2.

Each panel 20 comprises a horizontally elongated supporting member 22 which preferrably has a unit length substantially equal to the center-to-center distance between the I-shaped members 12 of the framework to which the panels 20 are to be attached. The supporting member 22 has a plurality of studs 24 for receiving screw-threaded fasteners, the studs 24 extending orthogonally from a face 26 of the supporting member 22 away from the I-shaped members 12 of the framework. In a preferred embodiment the supporting member 22 is a channel member and the studs 24 extend orthogonally from the web of the channel member.

An inside material-retaining sheet 28, having a stepwise discontinuity or angled portion 30 forming a shelf along the lower edge thereof, is hung from the plurality of studs 24. A generally rectangular block or layer of insulating material 32 is positioned against this inside material-retaining sheet 28 between the shelf 30 and the studs 24. In order that the insulating structural panel be as lightweight as possible yet have the desired strength, the material-retaining sheet 28 is preferably made of expanded metal lath. Where the material-retaining sheet 28 will be visible from the interior of the structure 10, a solid sheet of metal which can be decoratively coated may be preferable. Likewise, the insulating layer 32 is preferably made of a block of fiberglass 34 enveloped by a layer of plastic such as polyethylene to seal out any moisture. Other insulating materials may be used in certain circumstances.

A metal facing sheet 38 forms the outside surface of the insulating panel. The facing sheet 38 extends beyond the lateral dimensions of the rectangular block of insulating material 34 on at least one, and preferably two, of its four sides as will be best understood by a later consideration of FIG. 4. Tubular spacer means 40 surround the studs 24 and mainiain the necessary distance between the inside material retaining sheet 28 and the facing sheet 38 to prevent the collapse of the interstitial layer 32.

An upper margin defining means 42 is positioned between the insulating layer 32 and the facing sheet 38 to protect the layer 32 from damage prior to and during construction of the static structure 10. The upper margin defining means 42 also aids in the process of construction by presenting a continuous or nearly continuous upper edge to the structural insulating panel 20 as a unit. A plurality of vertically oriented reinforcing means 44 are also included as a sublayer behind the facing sheet 38 so as to reinforce the facing sheet to resist deformation due to wind loading or other stress. A load distributing means 46 overlays the facing sheet 38 while a plurality of screw-threaded fasteners 38 cooperatively engages studs 24 to secure the interposed elements of the panel 20 to form a unitized structural building block capable of utilization in many environments of which the static structure 10 illustrated in FIG. 1 is simply representative.

Upon careful consideration of FIG. 2 it will be noted that a first end 50 of the supporting member 22 is extended a substantial distance beyond the lateral edge 52 of material retaining sheet 28 and lateral edge 54 of the layer of insulating material 32. It will also be noted that the opposite end 56 of supporting member 22 is receded a similar substantial distance from the opposite lateral edges 58 and 60 of the retaining sheets 28 and insulating layer 32 respectively. This displacement of ends 50 and 56 with respect to the lateral edges of the remaining components of the insulating panel contributes significantly to the working interrelation of the panel 20 when combined with other similar panels as will become clear from a consideration of FIG. 4. The panel 20 illustrated in FIG. 2 is preferably manufactured in quantity in a facility where very stringent dimensional tolerances may be maintained and quality control continuously checked, in this way insuring that the panels 20 will satisfy the building requirements of the ultimate structure to which it is being applied.

Figure 3:
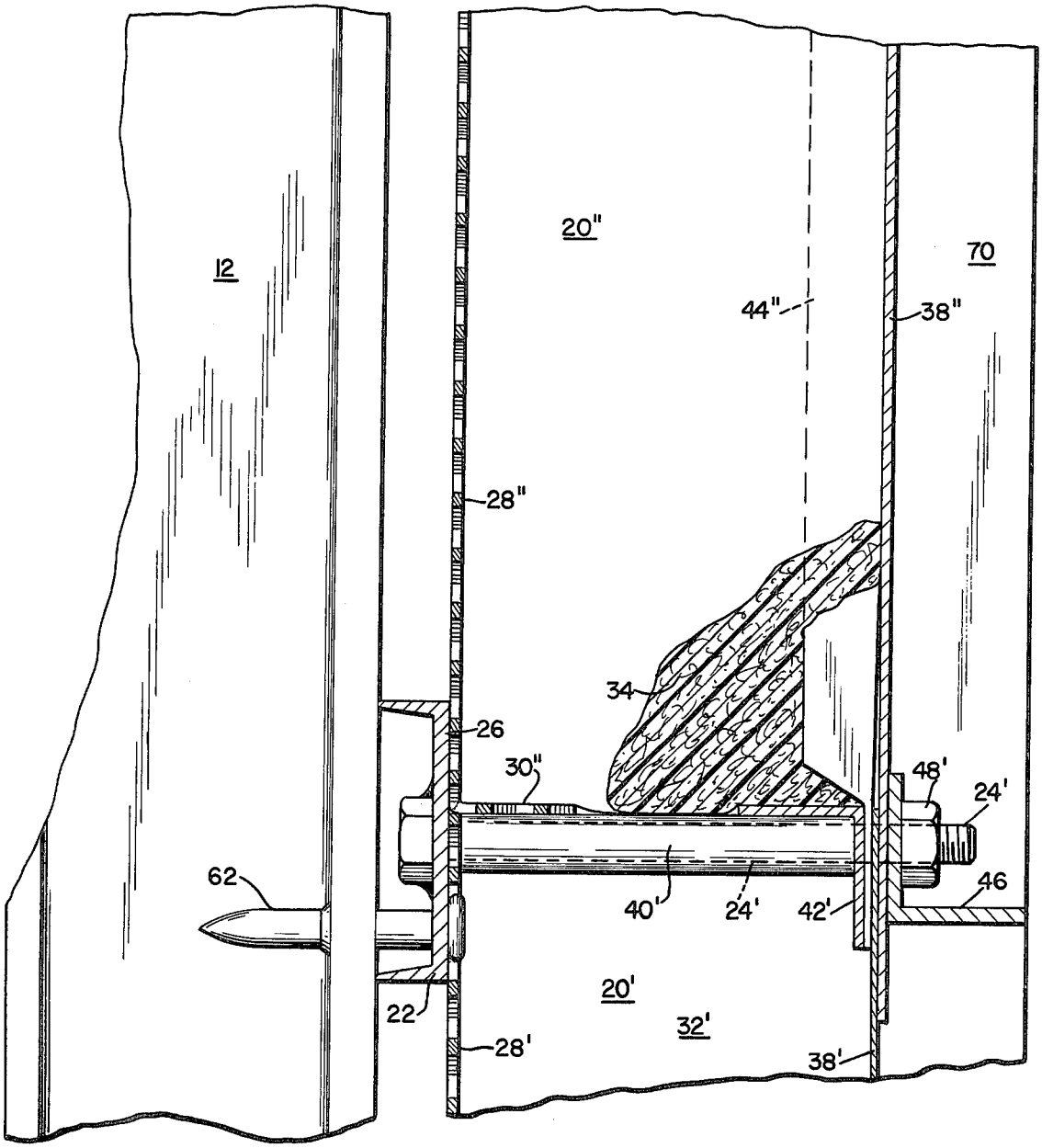
FIG. 3 is a sectional detailed view of the static structure shown in FIG. 1 cut along line 3—3.

The vertically cooperative arrangement between two insulating construction panels according to this invention is illustrated in FIG. 3. During the assembly of the static structure, a lower insulating construction panel 20' is first attached to a vertically oriented I-shaped member 12 by fastening the horizontally elongated supporting member 22 to the underlying framework by means of a ramset stud 62. The stud 62 fixes the supporting member 22 in place, the supporting member 22 carrying the remaining components of the lower panel 20' as a single construction unit. The lower panel 20' includes the material retaining sheet 28', the layer of insulating material 32', and the facing sheet 38' all of which are hung from studs 24' which are in turn fixed to the channel supporting member 22. The tubular spacer means 40' and upper margin defining means 42' are also included as integral portions of the lower construction panel 20'. Once the lower construction panel 20' has been fixed in position the screw-threaded fasteners 48' and load distributing means 46' are temporarily loosened or removed. An upper insulating construction panel 20'' is then positioned as illustrated such that the material retaining sheet 28'' contacts the face 26 of the supporting member 22 and the shelf 30'' rests on the tubular spacer means 40'. The vertically oriented reinforcing means 44'' are slotted on the lower end so as to engage the studs 24'. The facing sheet 38'' also includes apertures or slots shown in FIG. 2 as 64 along a lower margin which engage studs 24'. The load distributing means 46 and screw-threaded fasteners 48 are then replaced as shown and securely tightened in position.

Details of the inter-relationship between mating construction panels may be more fully appreciated by considering FIG. 4 which illustrates how the end 50 of supporting member 22 extends a substantial distance beyond the lateral edge 52 of the remaining components of the construction panel of which it is the supporting member 22. After the ramset stud 62 has fixed the panel on the lower right in place, the panel on the lower left is slipped into position by engaging the tongue-like projection 66 on end 56 of the lower left panel into the channeled portion of end 50 of the supporting member 22 of the lower right panel. Elevation and plan views of the tongue 66 and end 56 of the supporting member 22 are shown in FIGS. 5 and 6 respectively. The ends 50 and 56 of adjacent mating members are separated by a means providing for thermal expansion 68. The thermal expansion means 68 in its simplest form can consist of a ring or oval of a thermoplastic material such as nylon which is sliped over the tongue 66 to provide a space between ends 50 and 56 of two mating supporting members 22. At such time as the internal temperature of the static structure reaches the plastic or melting point of the thermal expansion members 68, it can deform or flow to provide sufficient room for the thermal expansion of members 22 which is necessary to prevent bending and buckling of the structure. The size of the thermal expansion means 68 will depend on the materials selected for supporting members 22 as well as the length of members 22 free for expansion in accordance with well known engineering principles. The thermal expansion means 68 should be selected so as to be form stable while the static structure 10 is under construction yet have a sufficently low temperature flow point that no damage will result to the structure due to thermal compression in this later dimension.

It is to be noted in FIG. 4 that the material-retaining sheet 28 lies in front of the face 26 of the supporting member 22. It should also be recognized that it is most desirable that the facing sheets 38 of all of the panels extend beyond the lateral dimensions of the remaining components of the panels 20, except the supporting members 22, of course, in order to provide a desired overlap to help seal out external weather conditions. In order that the external environment might be more fully excluded, vertical load distributing means, illustrated in FIG. 1 as 70, can be positioned directly on top of the overlapping areas of the facing sheets 38 and secured thereto by screw-threaded fasteners engaging studs 24 which extend through appropriate apertures in the facing sheet 38 and load distributing means 70.

Although the invention has been described in considerable details with reference to certain preferred embodiments thereof, it will be understood that variations and modifications can be effected within the spirit and scope of the invention as described above and as defined in the appended claims.

I claim

1. An insulating panel comprising:

(a) a horizontally elongated supporting member having a plurality of studs for receiving screw-threaded fasteners, the studs extending orthogonally from a face of the supporting member, (b) an inside material-retaining sheet, hung from the plurality of studs, the inside material-retaining sheet having an angled portion forming a shelf along the lower edge thereof, one end of said supporting member extending beyond a lateral edge of the inside material-retaining sheet, the opposite end of the supporting member receding a similar substantial distance from the opposite edge of the material-retaining sheet.

(c) a rectangular block of insulating material positioned against the inside material-retaining sheet between the shelf and the plurality of studs, (d) a continuous metal facing sheet positioned on the studs to form the outside surface of the insulating panel, the facing sheet extending beyond the lateral dimensions of the rectangular block of insulating material on at least two of its four sides, (e) tubular spacing means surrounding the studs between the inside material-retaining sheet and the facing sheet for maintaining the necessary distance between the material-retaining sheet and the facing sheet to prevent the collapse of the interstititial block of insulating material, and (f) a plurality of screw-threaded fasteners threaded on the plurality of studs for maintaining the enumerated components of the insulating panel in a fixed relationship with respect to each other.

2. The insulating panel of claim 1 wherein a tongue-like member projects from said opposite end of the supporting member for engaging an end of a like suporting member.

3. The insulating panel of claim 2 wherein a spacer means is fitted over the tongue-like member for separating the respective ends of adjacent supporting members.

4. The insulating panel of claim 3 wherein the spacer means comprises a ring of nylon.

5. The insulating panel of claim 1 wherein the horizontally elongated supporting member is a channel member and the plurality of studs extend orthogonally from the web of the channel member.

6. The insulating panel of claim 1 wherein the inside material-retaining sheet is a sheet of expanded metal lath.

7. The insulating panel of claim 1 wherein the block of insulating material is a block of fiberglass and binder enclosed in a substantially continuous enveloping sheet.

8. The insulating panel of claim 1 wherein the block of insulating material is a mass of fiberglass retained at a density of about 3.25 pounds per cubic foot in a stiff board-like configuration by a sodium silicate binder.

9. The insulating panel of claim 1 further comprising at least one vertically oriented reinforcing means positioned between the block of insulating material and the facing sheet for reinforcing the wind resistance of the facing sheet.

10. The insulating panel of claim 1 further comprising an upper margin defining means positioned between the block of insulating material and the facing sheet and extending over the top of the tubular spacer means for defining and strengthing the upper margin of the insulating panel.

11. The insulating panel of claim 1 further comprising a load distributing means having a unit length less than the unit dimension of the insulating panel in the horizontal direction, attached to the external face of the facing sheet by the screw-threaded fasteners cooperatively engaging the studs extending outwardly from the supporting member.

12. An insulating panel comprising:

(a) a horizontally elongated supporting member having a plurality of studs for receiving screw-threaded fasteners, these studs extending orthogonally from a face of the supporting member, and having a tongue-like member projecting from an end for engaging a mating end of a like supporting member, (b) an inside material-retaining sheet, hung from the plurality of studs, the inside material-retaining sheet having an angled portion forming a shelf along the lower edge thereof, one end of said supporting member extending a substantial distance beyond a lateral edge of the inside material-retaining sheet while the opposite end of the supporting member is receded a similar substantial distance from the opposite edge of the material-retaining sheet, (c) a rectangular block of insulating material positioned against and aligned with the inside material-retaining sheet between the shelf and the plurality of studs, (d) a continuous metal facing sheet positioned on the studs to form the outside surface of the insulating panel, the facing sheet extending slightly beyond the lateral dimensions of the rectangular block of insulating material on at least two of its four sides, (e) tubular spacing means surrounding the studs between the inside material-retaining sheet and the facing sheet for maintaining the necessary distance between the material-retaining sheet and the facing sheet to prevent the collapse of the interstitial block of insulating material, (f) upper margin defining means positioned between the block of insulating material and the facing sheet and extending over the top of the tubular spacer means for defining the strengthening the upper margin of the insulating panel, (g) at least one vertically oriented reinforcing means positioned between the block of insulating material and the facing sheet for reinforcing the wind resistance of the facing sheet, (h) a load distributing means having a unit length less than the unit dimension of the insulating panel in the horizontal direction, attached to the external face of the facing sheet, and (i) a plurality of screw-threaded fasteners threaded on the plurality of studs for maintaining the enumerated components of the insulating panel in a fixed relationship with respect to each other.

* * * * *